US005112110A

United States Patent [19]

Perkins

[11] Patent Number: 5,112,110

[45] Date of Patent: May 12, 1992

[54] SEATING UNIT HAVING LOCKABLE CUSHIONS

[75] Inventor: Landon E. Perkins, Martinsville. Va.

[73] Assignee: Ladd Furniture, High Point, N.C.

[21] Appl. No.: 606,436

[22] Filed: Oct. 29, 1990

[51] Int. Cl.[5] ..... A47C 4/02

[52] U.S. Cl. ..... 297/440; 297/283; 297/443

[58] Field of Search ..... 297/440, 443, 444, 283

[56] References Cited

U.S. PATENT DOCUMENTS

| | | | |
|---|---|---|---|
| 1,695,101 | 12/1928 | Hoffman | 297/283 |
| 4,023,860 | 5/1977 | Harder, Jr. | 297/444 X |
| 4,045,080 | 8/1977 | Barecki et al. | 297/283 |
| 4,395,071 | 7/1983 | Laird | 297/440 |
| 4,488,755 | 12/1984 | Nemschoff | 297/443 |
| 4,492,409 | 1/1985 | Laird | 297/440 |
| 4,755,000 | 7/1988 | Chiaro et al. | 297/440 |

*Primary Examiner*—Peter R. Brown
*Attorney, Agent, or Firm*—Rhodes, Coats & Bennett

[57] ABSTRACT

A seating unit having lockable cushions. The seating unit includes a plurality of cushion guides for receiving the bottom and back cushions and a locking assembly which extends behind the backs of the cushions along the length of the frame for engaging the rear of each of the cushions. The locking assembly includes a locking bar having a plurality of slots which permit reversible lock pins located at the rear of the cushions to be received thereby. The locking bar is slidably received between the end cushion guide assemblies and is movable between a first locking position and a second unlocking position. A plunger-type lock located at one end of the locking bar prevents the locking bar from moving from its locking position. A biasing means located at the other end of the locking bar assists the release of the locking bar when the locking plunger is released. Accordingly, once the cushions are in place, engagement of the lock shifts the locking bar to its locking position thereby simultaneously engaging and locking the plurality of bottom and back cushions.

23 Claims, 7 Drawing Sheets

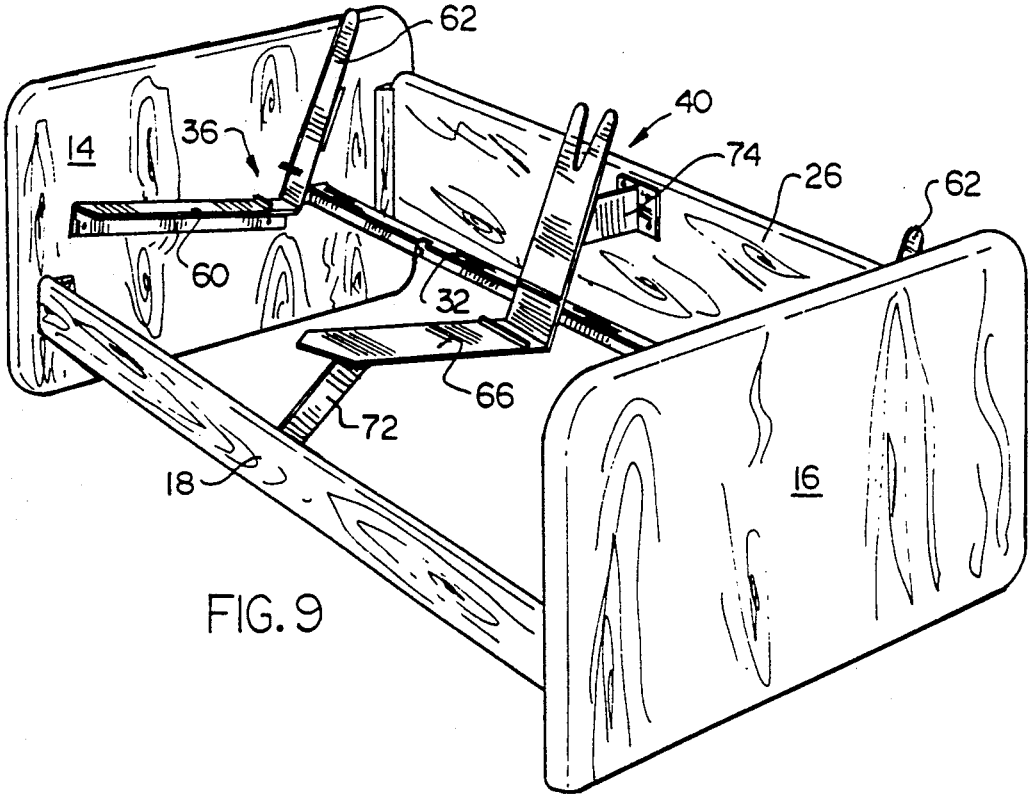
FIG. 9
FIG. 10
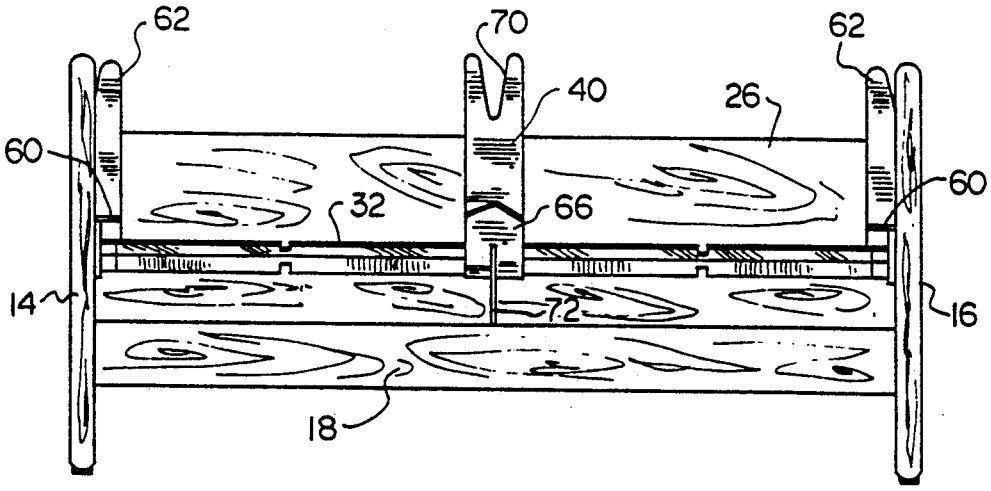

SEATING UNIT HAVING LOCKABLE CUSHIONS

BACKGROUND OF THE INVENTION (1) Field of the Invention

The present invention relates generally to seating units and, more particularly, to a seating unit having means for locking the bottom and back cushions in place to prevent unauthorized removal.

(2) Description of the Prior Art

Seating units such as chairs, love seats and sofas or the like are often used in contract or institutional settings. Such units must be of extra durable construction in order to survive long-term abuse. Typically, the bottom and back cushions of furniture used in institutions such as schools and hospitals are not removable in order to prevent unauthorized removal due to horseplay or theft. However, since the cushions cannot be removed or turned over and used again, the life of such furniture is more limited than desirable.

U.S. Pat. No. 1,695,101, issued to Hoffman, discloses a sofa or the like having a reversible back whereby the back may be upholstered in different colors or materials. The sofa or the like disclosed by Hoffman includes means for securing the back upon the frame of the furniture and for readily releasing and reversing the back.

U.S. Patent 4,045,080, issued to Barecki et.al., discloses a removable insert for a transit chair shell. A plurality of studs protrude from the back of the shell and a plurality of openings in the shell receive the studs. A movable restraining means prevents withdrawal of the studs thereby securely positioning the insert to the chair shell.

One design more suitable for conventional chairs, love seats or sofas is taught by U.S. Pat. No. 4,488,755, issued to Nemschoff. The seating unit, as taught by Nemschoff, includes opposite, upright rigidly connected side members, a reversible bottom. cushion having a back face, and a reversible back cushion having a bottom face. A beam extends laterally between the side members and supports rod-like cantilevered legs which are slidably received in bores in an internal frame in each of the bottom and back cushions. A releasable detent device is located inside each bore which is engaged by each cushion by full installation of the cushion on the legs and prevents outward movement of the cushions.

U.S. Pat. Nos. 4,395,071 and 4,492,409, both issued to Laird, disclose a somewhat similar approach to solving the same problem. The furniture, as taught by Laird, includes a frame having at least one removable cushion. The cushion has oppositely disposed grooves adapted to receive a corresponding tongue on the frame of the furniture. A latch mechanism is provided within each cushion for cooperating with a mating structure on its associated tongue. Thus, the individual cushions may be removed and replace by another similar cushion or may be turned over and reinstalled.

Such systems have a plurality of individual locks at the rear of each cushion which can be open to allow the cushion to be removed. However, for a typical three-cushion sofa unit, this would require six separate locks to be opened each time it is desired to rotate, clean or otherwise remove the bottom and back cushions.

Finally, U.S. Pat. No. 4,755,000, issued to Chairo et.al., also discloses a seating unit having removable and reversible cushions. Like the above-referenced Nemschoff and Laird patents, each cushion is slidably mounted to a frame. The rear portion of the bottom cushion engages the bottom portion of a corresponding back cushion to lock them together. In addition, one of the cushions is also locked to the frame. Thus, a pair of bottom and back cushions may be locked and unlocked together. However, for love seats and sofas having a plurality of bottom and back cushions, separate locks would be required for each pair of back and bottom cushions.

Thus, there remains a need for a new and improved seating unit having lockable cushions which is operable to simultaneously release a plurality of bottom and back cushions without the necessity for operating numerous locks. In addition to providing security for the cushions, the seating unit should provide a pleasing appearance and comfort.

SUMMARY OF THE INVENTION

The present invention is directed to a seating unit having lockable cushions which includes a plurality of cushion guides for receiving the bottom and back cushions and a locking assembly which extends behind the backs of the cushions along the length of the frame for engaging the rear of each of the cushions. The locking assembly includes a locking bar having a plurality of slots which permit reversible lock pins located at the rear of the cushions to be received thereby. The locking bar is slidably received between the end cushion guide assemblies and is movable between a first locking position and a second unlocking position. A plunger-type lock located at one end of the locking bar prevents the locking bar from moving from its locking position. A biasing means located at the other end of the locking bar assists the release of the locking bar when the locking plunger is released. Accordingly, once the cushions are in place, engagement of the lock shifts the locking bar to its locking position thereby simultaneously engaging and locking the plurality of bottom and back cushions. Conversely, when the lock is disengaged, the biasing means is operable to automatically shift the locking bar to its unlocked position and simultaneously release the plurality of bottom and back cushions.

Accordingly, one aspect of the present invention is to provide a seating unit having lockable cushions. The seating unit includes a frame; at least one removable cushion; means associated with the frame and the cushion for receiving and positioning the cushion in a seating arrangement; and locking means associated with the frame for engagement with the cushion, thereby preventing the unauthorized removal of the cushion. The locking means includes an elongated bar movably attached between the vertically disposed ends of the frame and aligned substantially parallel to the rear surface of the cushion and perpendicular to the guides, the bar being movable between first and second positions; and attachment means associated with the bar adapted for engagement with the cushion in the first position and for disengagement with the cushion in the second position.

Another aspect of the present invention is to provide a locking mechanism for securing a cushion to the frame of a seating unit of the chair, love seat or sofa type. The locking mechanism includes means associated with the frame and the cushion for receiving and positioning the cushion in a seating arrangement; an elongated bar movably attached between the vertically disposed ends of the frame and substantially parallel to the rear surface of the cushion and aligned therewith, the bar being movable between first and second positions; and attachment means associated with the bar adapted for engagement with the cushion in the first position and for disengagement with the cushion in the second position, thereby preventing the unauthorized removal of the cushion.

Still another aspect of the present invention is to provide a seating unit of the chair, love seat or sofa type. The seating unit includes a frame having at least one pair of opposing guides; at least one pair of removable bottom cushions having oppositely disposed grooves for receiving the guides; and locking means associated with the frame for simultaneous engagement with the cushions, thereby preventing the unauthorized removal of the cushions. The locking means includes an elongated bar movably attached between the vertically disposed ends of the frame and aligned substantially parallel to the rear surface of the cushions and perpendicular to the guides, the bar being movable between first and second positions; attachment means associated with the bar adapted for engagement with the cushions in the first position and for disengagement with the cushions in the second position; and a releasable lock for securing the bar in the first position.

These and other aspects of the present invention will become apparent to those skilled in the art after a reading of the following description of the preferred embodiment when considered with the drawings.

BRIEF DESCRIPTION OF THE DRAWINGS

FIG. 9 is a perspective view of the frame assembly, cushion guides, and locking mechanism of the seating unit in FIG. 1 with the cushions removed;

FIG. 10 is an elevated front view of the frame assembly, cushions guides, and locking mechanism of the seating unit in FIG. 1 with the cushions removed;

Figure 11:
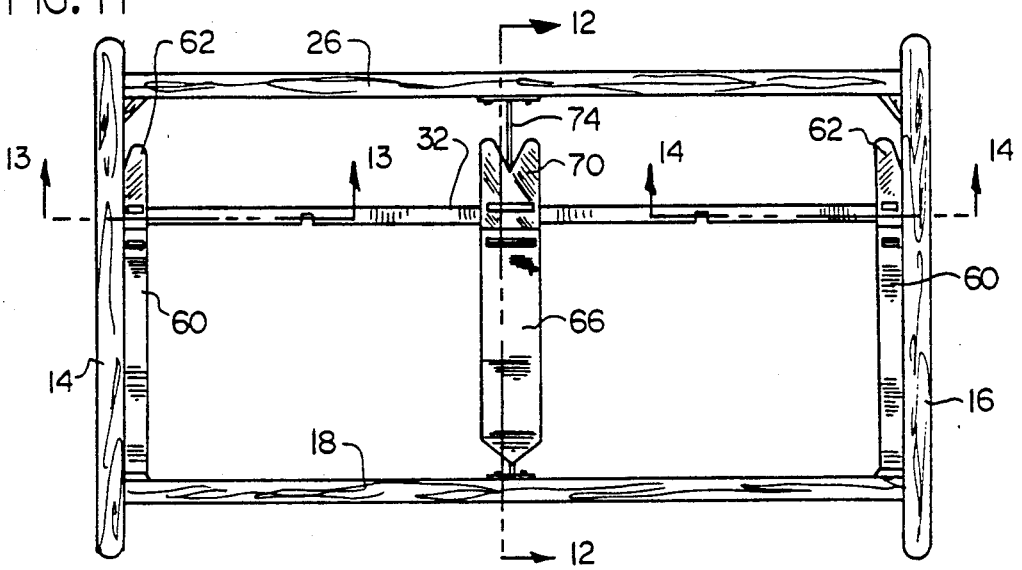
FIG. 11 is a top view of the frame assembly, cushion guides, and locking mechanism of the seating unit shown in the cushions removed.
Figure 15:
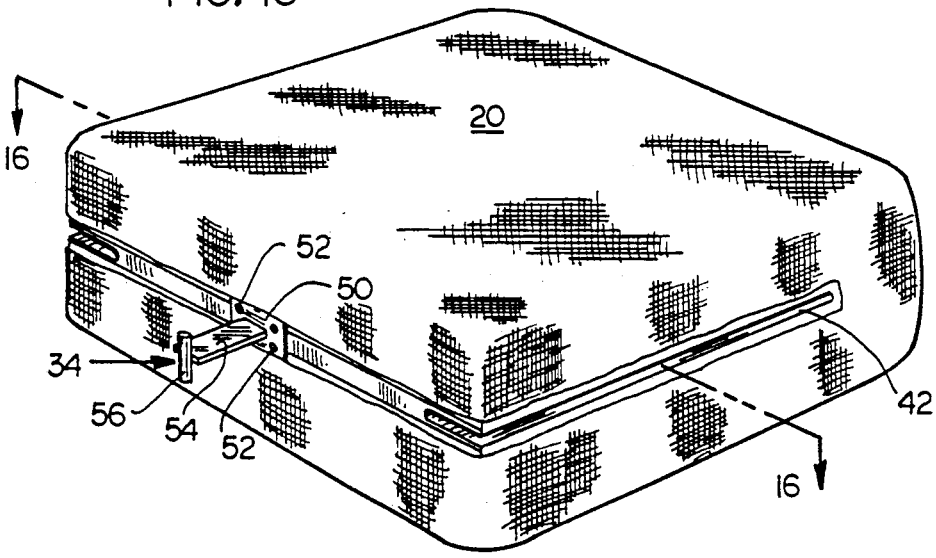
Figure 16:
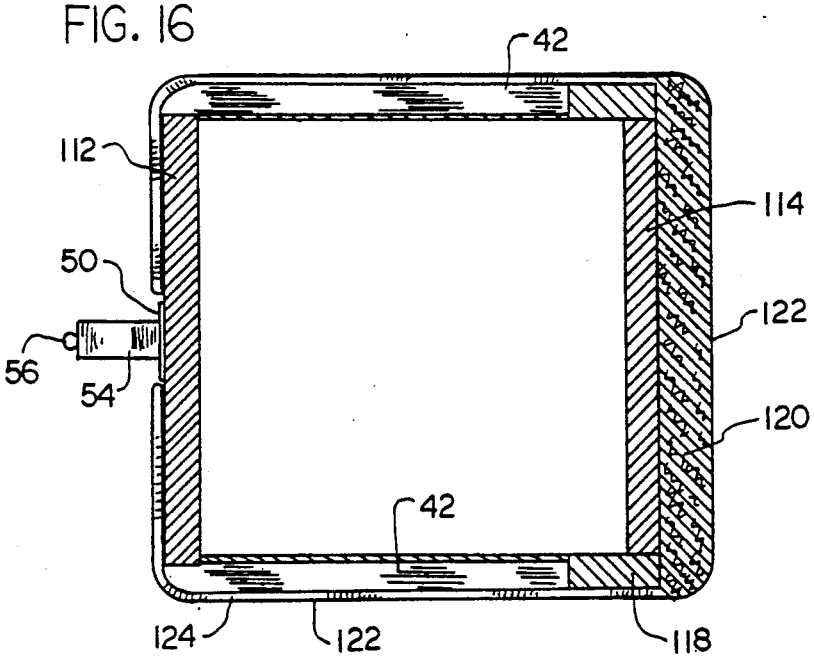

FIG. an enlarged vertical sectional view of the other end of the locking mechanism shown in FIG. 11, taken 14—14;

FIG. 15 is a rear perspective view of a cushion for the seatin unit constructed according to the present invention;

FIG. 16 is a horizontal sectional view of the cushion shown in FIG. 15 taken along lines 16—16.

DESCRIPTION OF THE PREFERRED EMBODIMENTS

In the following description, like references characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 1:
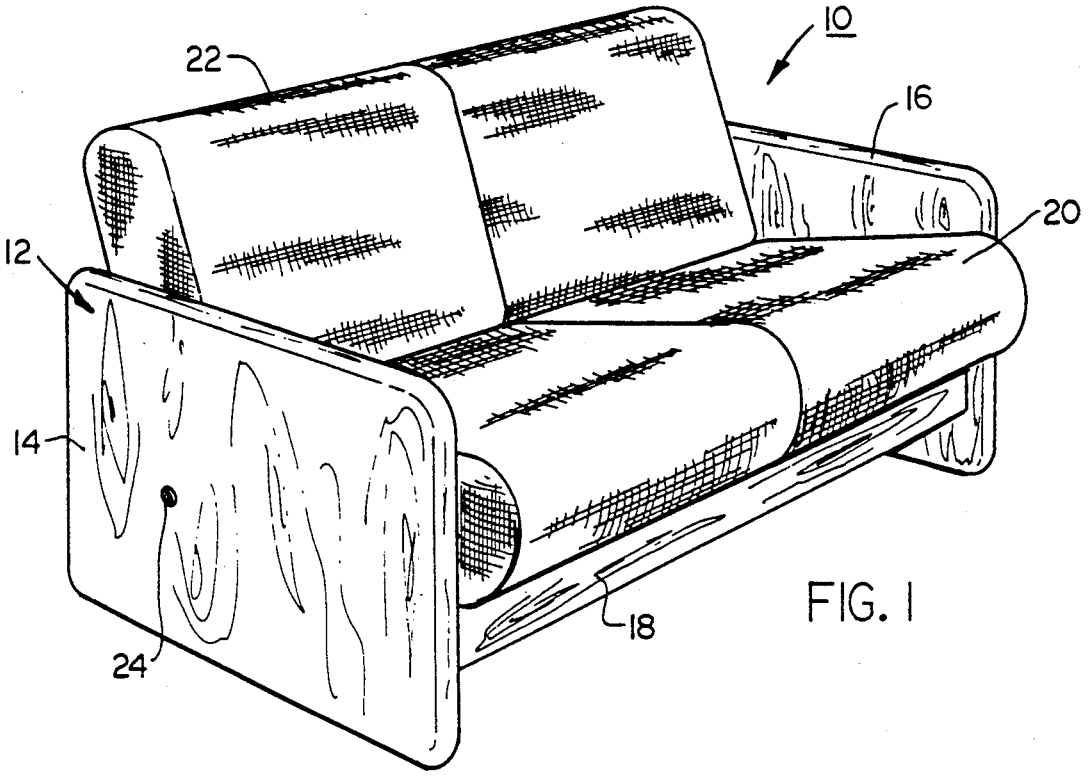
FIG. 1 is a front perspective view of a seating unit to the present invention.

Referring to the drawings in general and FIG. 1 in particular, it will be understood that the illustrations are for the purpose of describing a preferred embodiment of the invention and are not intended to limit the invention thereto. As best seen in FIG. 1, a seating unit generally designated 10 is shown constructed according to the present invention.

Figure 2:
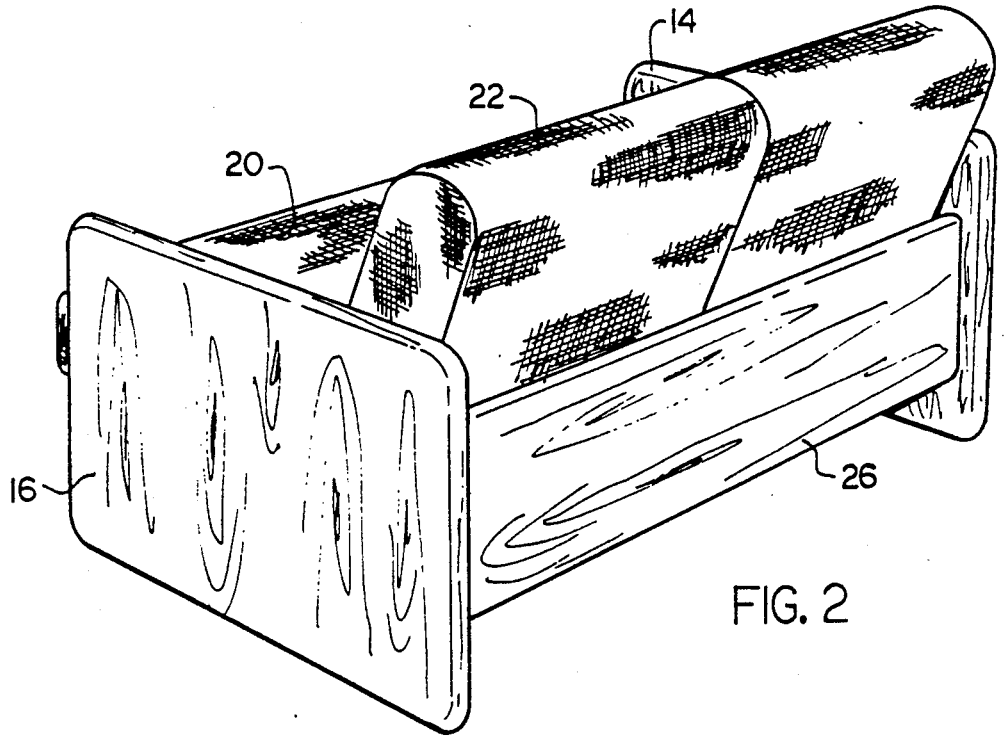
FIG. 2 is a rear perspective view of the seating unit shown in FIG. 1.
Figure 3:
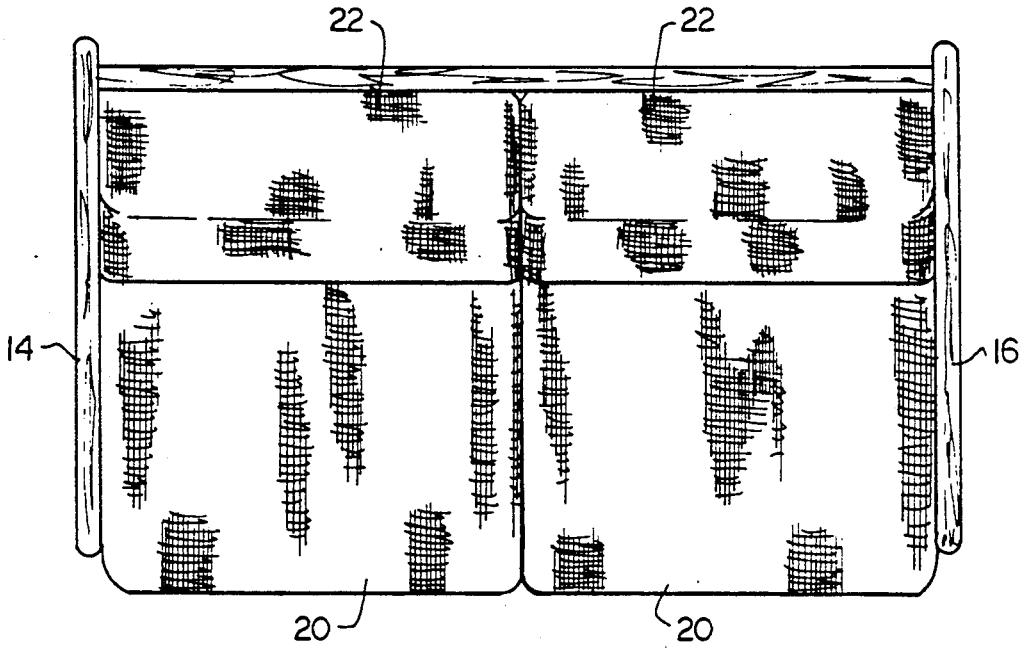
FIG. 3 is a top view of the seating unit shown in FIG. 1.

Seating unit 10 includes a frame assembly 12 having a pair of side panels 14,16 and a kick board 18 attached therebetween. The seating unit 10 includes at least one bottom cushion 20 and one back cushion 22. However, the seating unit will generally include between one and three pairs of bottom and back cushions. A lock assembly 24 is located in the outer surface of side panel 14. As best seen in FIG. 2, a rear frame support 26 extends between side panels 14,16 to provide additional support to frame assembly 12. A top view of the seating unit shown in FIG. 1 is illustrated in FIG. 3.

Figure 4:
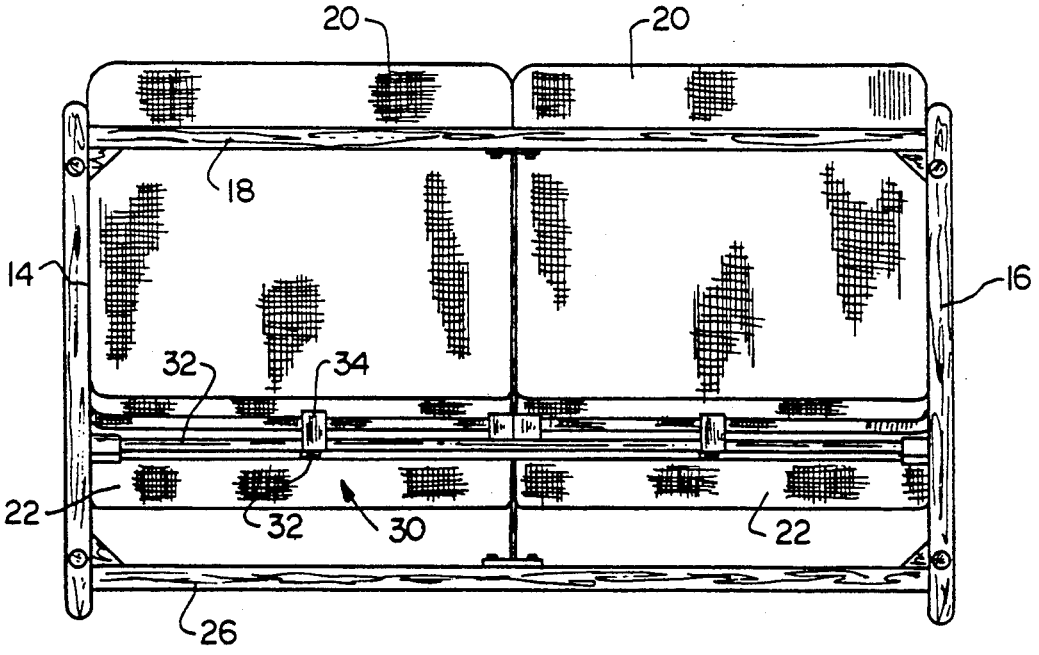
FIG. 4 is bottom view of the seating unit shown in FIG. 1.

As best seen in FIG. 4, there is illustrated a bottom view of the seating unit shown in FIG. 1. A locking assembly, generally designated 30, extends between side panels 14,16. Locking assembly includes a locking bar sub-assembly 32, a bottom cushion lock sub-assembly 34, and a back cushion sub-assembly 35. In the preferred embodiment, each of the cushion lock subassemblies 34,35 are substantially identical to one another.

Figure 5:
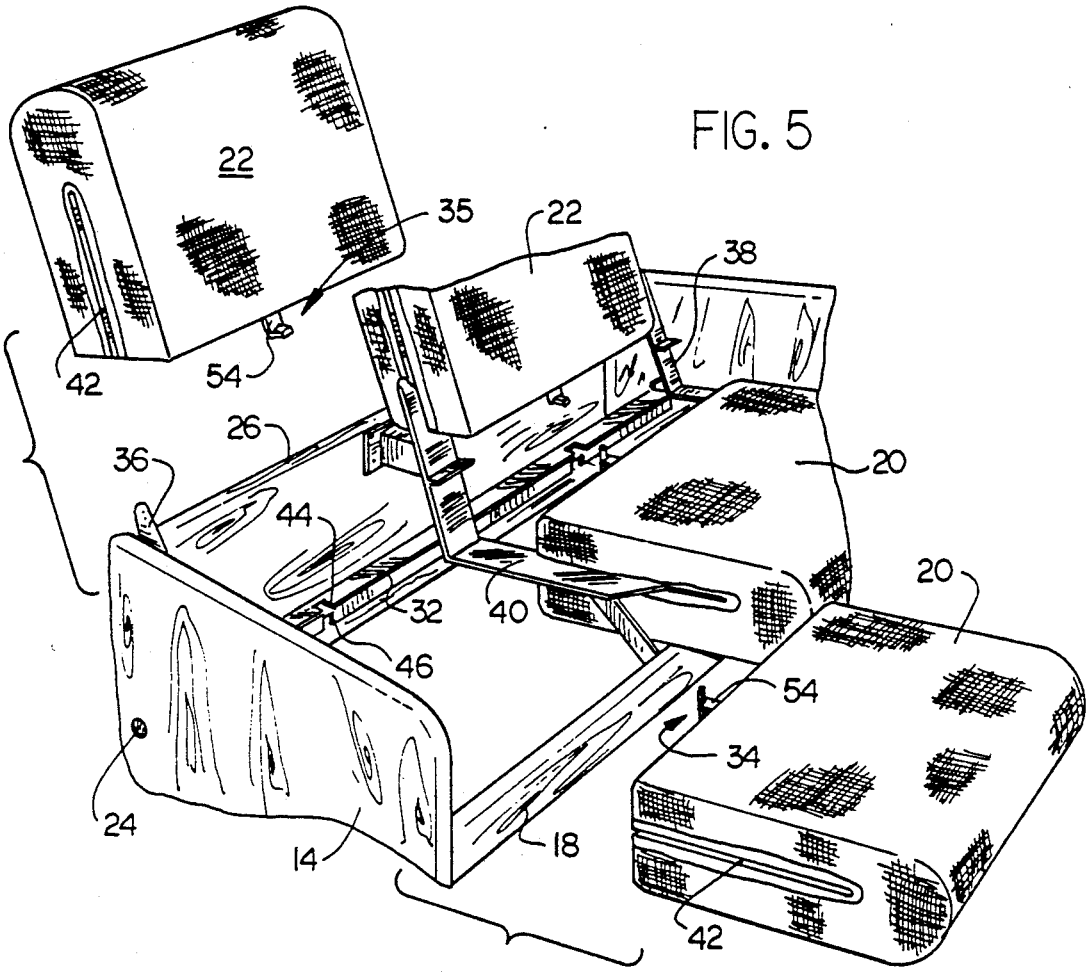
FIG. 5 is a partially exploded view of the seating unit shown in FIG. 1, illustrating a center cushion guide assembly.

Turning now to FIG. 5, there is shown a partially exploded view of the seating unit shown in FIG. 1 illustrating the cushion guide assembly for receiving cushions 20,22. In the embodiment shown, the cushion guide assembly includes a pair of end cushion guide assemblies 36,38 and a center cushion guide assembly 40. As can be seen, each of the bottom and back cushions 20,22 includes a pair of receiving grooves 42 along the edge of bottom and back cushions 20,22 for mating with the cushion guide assemblies 36, 38 and 40. For a three cushion sofa, a second center cushion guide 40 is added.

Figure 6:
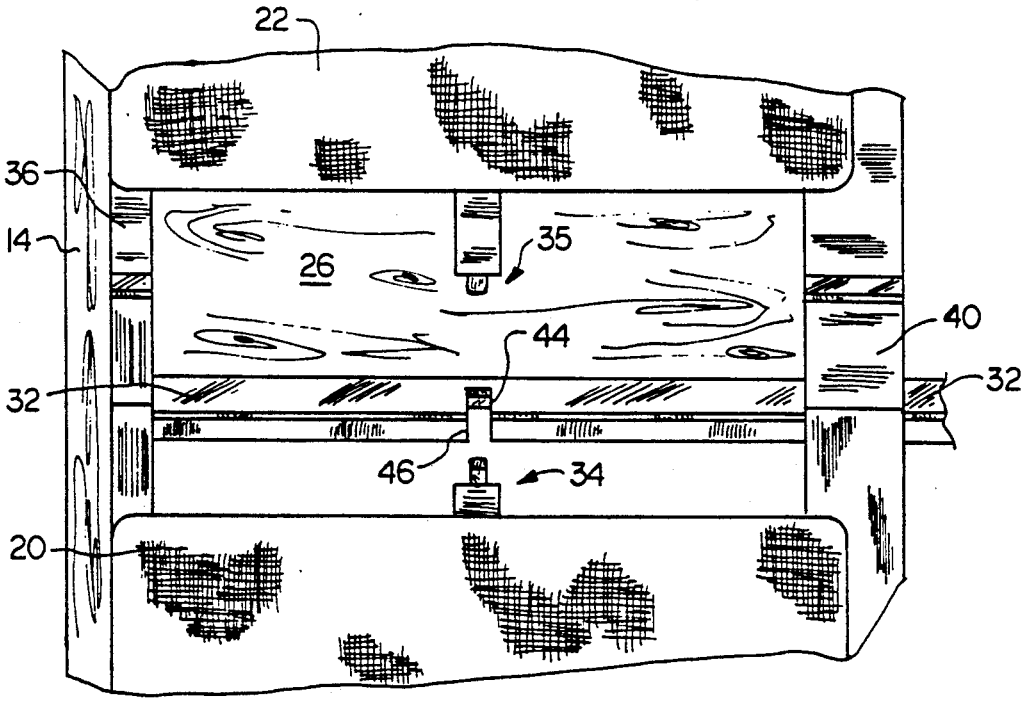
FIG. 6 is an enlarged front view of the seating unit shown in FIG. 1 showing one pair of bottom and back cushions withdrawn.
Figure 7:
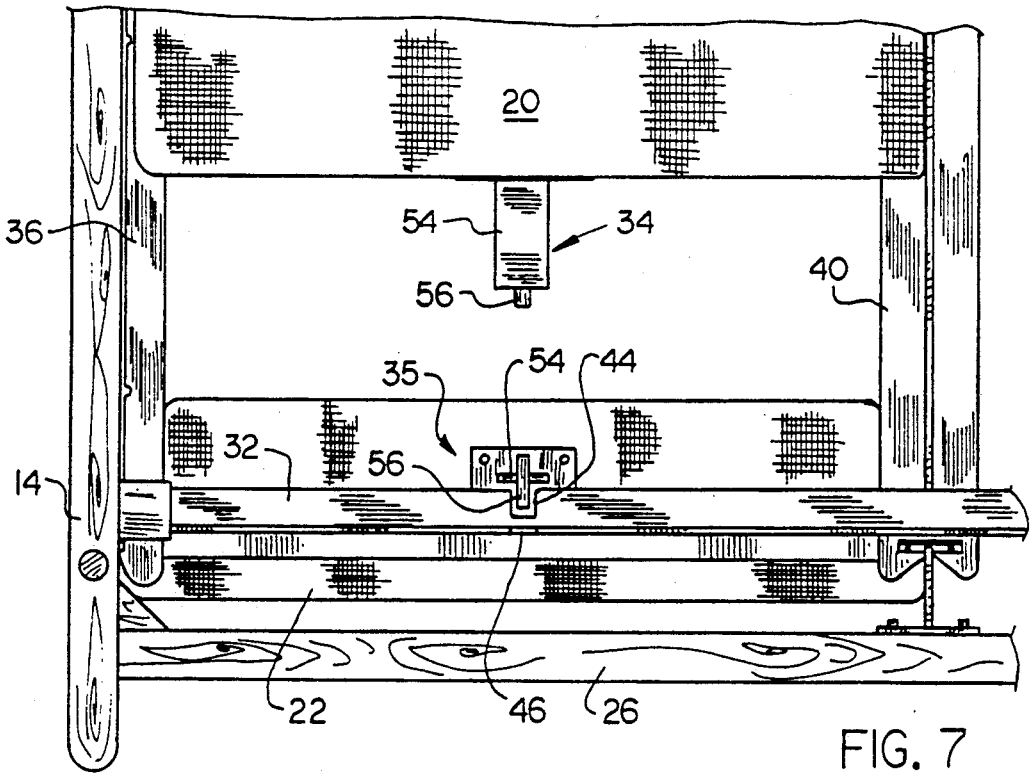
FIG. 7 is an enlarged bottom view of the seating unit shown in 1 showing one pair of bottom and back cushions withdrawn.

As best seen in FIG. 6, there is shown an enlarged front view of the seating unit 10 shown in FIG. 1 showing one pair of bottom and back cushions 20,22 partially withdrawn. Locking bar sub-assembly 32 includes a pair of back and bottom cushion lock pin slots 44,46 for engaging cushion lock sub-assemblies 34,35. An enlarged bottom view of the seating unit 10 shown in FIG. 1 showing the pair of bottom and back cushions 20,22 partially withdrawn is shown in FIG. 7.

Figure 8:
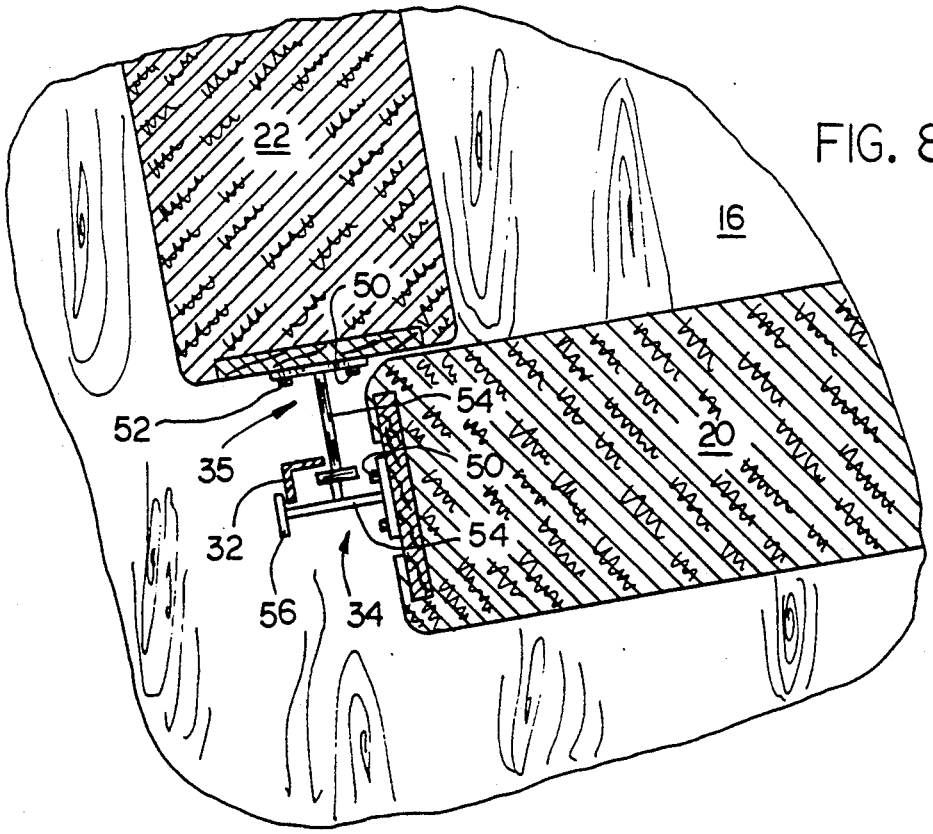
FIG. 8 is an enlarged partial vertical sectional view of a locking mechanism shown in FIG. 6 taken along lines 8—8 illustrating relationship of the locking bar and cushion lock pins.

As best seen in FIG. 8, there is shown an enlarged partial vertical sectional view of the locking assembly 30 shown in FIG. 6, taken along lines 8—8 illustrating the relationship of the locking bar 32 and cushion lock sub-assemblies 34,35. In the preferred embodiment, each of the cushion lock sub-assemblies 34,35 include a base 50 attached to the rear of either of cushions 20,22 by conventional attachment means 52. An elongated extension plate 54 is welded or otherwise attached to base 50 and extends outwardly therefrom. The length of extension plate 54 for the bottom and back cushions may differ somewhat depending on the overall geometry of the seating unit 10. A lock pin 56 is also suitably attached by welding or other means to the opposite end of extension plate 54. In a preferred embodiment, the cushion lock sub-assemblies 34,35 are symmetrical about the plane defined by the extension plate 54, thereby allowing the cushions 20,22 to be reversed. As also can be seen, locking bar sub-assembly 32 preferably has an L-shaped cross-section thereby permitting it to engage both bottom cushion lock sub-assembly 34 and back cushion lock sub-assembly 35 simultaneously. In addition, because of the symmetry of extension plate 54, one or more of the cushions 20,22 can be reversed without requiring any further adjustment of the locking bar assembly 32.

Turning now to FIG. 9, there is shown a perspective view of the frame assembly 12, cushion guides 36, 38 and 40 and locking assembly 30. Each of the end cushion guide assemblies 36,38 includes an end cushion bottom guide tongue 60 and an end cushion back guide tongue 62 for receiving cushions 20,22 respectively. Conventional attachment means 64 attach end cushion guide assemblies 36,38 to the inner surface of side panels 14,16. Center cushion guide assembly 40 includes a center bottom cushion guide tongue 66 and a center back cushion guide tongue 70. A lower support brace 72 is attached to the underside of the center back cushion guide plate 70 and to the inner surface of kick board 18. An upper support brace 74 is attached between center back cushion guide 70 and the inner surface of back frame support 26.

As best seen in FIG. 10, the ends of the back cushion guide tongues 62,70 are tapered inwardly towards the cushion back (not shown). This prevents contact between an occupant on the seating unit and the upper edge of the back cushion guide tongues 62,70 when the cushions are in place, since the ends of the back cushion guide tongues 62,70 are recessed sufficiently within the cushions to prevent inadvertent contact with an occupant. A top view of the frame assembly 12, cushion guides 36, 38, and 40, and locking assembly 30 of the seating unit 10 is shown in FIG. 11.

Figure 12:
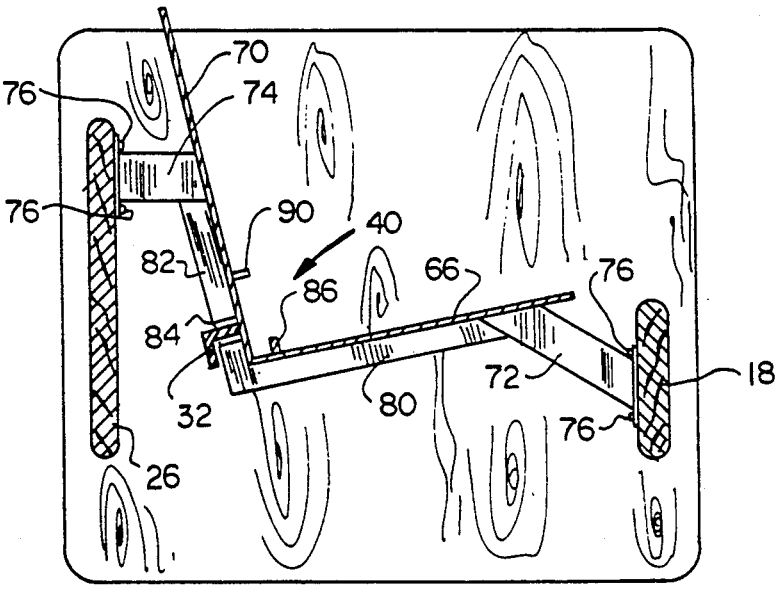
FIG. 12 is a partial vertical sectional view of the center cushio shown in FIG. 11 taken along lines 12—12.

A partial vertical sectional view of the center cushion guide assembly 40 is shown in FIG. 12. The center cushion guide assembly 40 includes a support 80 for the bottom cushion guide tongue 66 and a second support 82 for the back cushion guide tongue 70. Attachment means 76 are attached to the ends of lower support brace 72 and upper support brace 74 to secure the center cushion guide assembly 40 to kick board 18 and back support 26 respectively. In the preferred embodiment, a slot 84 extends through a portion of supports 80,82 for receiving and guiding locking bar 32. This construction reduces the unsupported length of the locking bar 32 to about one cushion width, thereby increasing the strength of the locking assembly 30 without the necessity of increasing the size of locking bar 32. Center cushion guide tongues 66,70 include a bottom cushion stop 86 and a back cushion stop 90 for engaging cushions 20,22 and aligning the cushions 20,22 in the proper position to facilitate engagement with locking bar 32.

Figure 13:
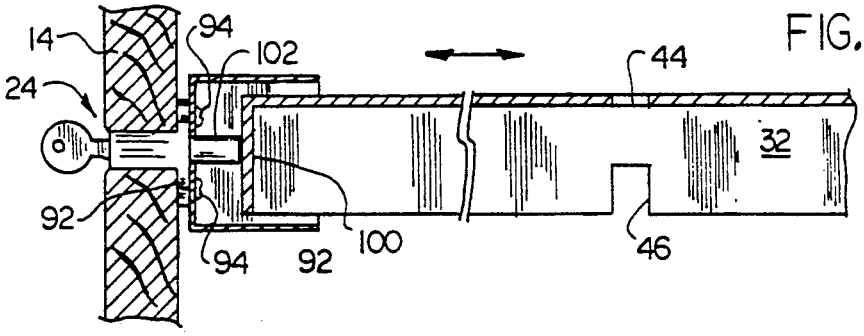
FIG. 13 is an enlarged vertical section view of one end of the locking mechanism shown in FIG. 11, taken along 13—13.

Turning now to FIG. 13, an enlarged vertical sectional view of one end of the locking assembly 30 is shown. Lock 24 includes a lock flange 92 for preventing the lock 24 from being withdrawn through side wall panel 14. Conventional attachment means 94 secure lock flanges 92 to the inner surface of side panel 14. A first locking bar guide 96 is attached to the rearward portion of end cushion guide assembly 36 for receiving one end of locking bar 32. A first rectangular end cap 100 is welded to the end of L-shaped cross-section locking bar 32. Locking bar guide 96 has a similar rectangular cross-section and is sized to receive first rectangular end cap 100 thereby being operable to prevent rotation of locking bar 32 about its axis. Lock 24 includes a lock plunger 102 which engages the outer surface of first rectangular end cap 100 and biases it into a locking position.

Figure 14:
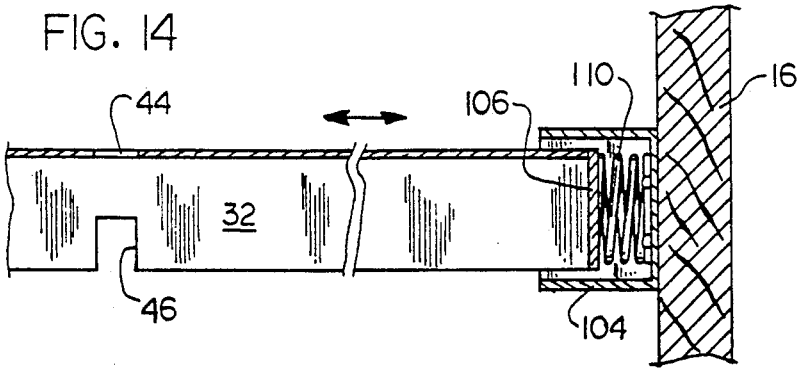

As is best seen in FIG. 14, the other end of locking assembly 30 incudes a second locking bar guide 104 attached to the rearward portion of end cushion guide assembly 38. A second rectangular end cap 106 is also welded along the opposite end of locking bar 32 to prevent rotation of locking bar 32. In the preferred embodiment, a spring biasing means 110 is positioned between inner surface of side panel 16 and inner surface of second rectangular end cap 106. This arrangement provide for an automatic release of locking bar 32 when plunger 102 is released.

Finally, a rear perspective view of a cushion for the seating unit 10 constructed according to the present invention is shown in FIG. 15. Slots 42 extend along the length of the sides of the cushion. The interior construction of the cushion is best seen in the FIG. 16. The interior of the cushion includes a rear cushion cross brace 112 and front cushion cross brace 114. A pair of side cushion cross braces 116,118 are attached therebetween. A cushion pad 120 is wrapped around the upper, front and lower surfaces of the cushion framework. The outer cushion fabric 122 surrounds the cushion framework and cushion pad 120. Loop and pile fastener strips 124 extend along perimeter of the side cushion cross braces 116,118 and along the front of rear cushion cross brace 112 for holding the cushion outer fabric 122 in place.

Certain modifications and improvements will occur to those skilled in the art upon reading of the foregoing description. By way of example, instead of the slot and pin arrangement for engaging the cushion, a hook and eyelet arrangement would also permit the locking bar to engage the cushions while still providing a symmetrical connector on the cushion back. Also the tongue and external groove means for positioning the cushions could be replaced by rods received by internal bores within the cushions. It should be understood that all such modifications and improvements have been deleted herein for the sake of conciseness and readability but are properly within the scope of the following claims.

I claim:

1. A seating unit, said seating unit comprising:

(a) a frame having vertically disposed ends;

(b) at least one removable seat cushion and back cushion;

(c) means associated with said frame and said cushions for receiving and positioning said cushions in a seating arrangement; and (d) locking means associated with said frame for engagement with said cushions, thereby preventing the unauthorized removal of said cushions, said locking means including:

(i) an elongated bar movably attached between the vertically disposed ends of said frame and aligned substantially parallel to the rear surface of said cushions and perpendicular to said positioning means, said bar being movable between first and second positins; and (ii) attachment means in the form of apertures in said bar adapted for engagement with complimentary means on both of said cushions in said first position and for disengagement with said complimentry means cushions in said second position.

2. The seating unit according to claim 1, further including a releasable lock located between one end of said bar and said frame for securing said bar in said first position.

3. The seating unit according to claim 1, wherein said means associated with said frame and said cushion for receiving and positioning said cushion in a seating arrangement includes at least one pair of opposing guides attached to said frame and oppositely disposed grooves associated with said removable cushion for receiving said guides.

4. The seating unit according to claim 3, wherein at least one of said guides is attached to the inner surface of a vertically disposed end of said frame.

5. The seating unit according to claim 4, wherein said guides are tilted so that the rear ends of said guides are lower than the front ends of said guides.

6. The seating unit according to claim 3, wherein said pair of oppositely disposed grooves extends partially along the length of said cushion and arranged so as to be visible only at the sides of said cushion.

7. The seating unit according to claim 3, wherein said cushion has a padded framework surrounded by an outer covering and said grooves are arranged on opposite sides of said framework.

8. The seating unit according to claim 1, wherein said removable cushion is a bottom cushion and further including a back cushion attached to said frame.

9. The seating unit according to claim 8, wherein said back cushion is in overlying relationship with the innermost end of said bottom cushion so that said locking means is obscured by said back cushion.

10. A locking mechanism for securing seat and back cushions to the frame of a seating unit of the chair, love seat or sofa type in which the frame has vertically disposed ends, said locking mechanism comprising:

(a) means associated with the frame and the cushions for receiving and positioning the cushions in a seating arrangement;

(b) an elongated bar movably attached between the verticaly disposed ends of the frame and substantially parallel to the rear surface of the cushions and aligned therewith, said bar being movable between first and second positions; and (c) attachment means in the form of apertures in said bar adapted for engagement with both of the cushions in said first position and for disengagement with said complimentary means in said second position, thereby preventing the unauthorized removal of the cushions when said bar is in said first position.

11. The locking mechanism according to claim 10, wherein said means associated with the frame and the cushions for receiving and positionng the cushions in a seating arrangement includes at least one pair of opposing guides attachable to the frame.

12. The locking mechanism according to claim 10, further including a releasable lock located between one end of the bar and the frame for securing the bar in said first position.

13. The locking mechamsim according to claim 10, wherein said complementary means is symmetrically shaped, thereby permitting said cushions to be reversed without adjusting the position of said locking bar.

14. The locking mechanism according to claim 13, wherein said complementry means is located along the rearward end of the seat cushion approximately equidistant from the sides and top and bottom surfaces thereof.

15. A seating unit of the chair, love seat or sofa type, said seating unit comprising:

(a) a frame having vertically disposed ends and at least one pair of opposing guides;

(b) at least one pair of removable seat and back cushions having oppositely disposed grooves for receiving said guides;

(c) locking means associated with said frame for simultaneous engagement with said seat and back cushions, thereby preventing the unauthorized removal of said cushions, said locking means including:

(i) an elongated bar movably attached between the vertically disposed ends of said frame and aligned substantially parallel to the rear surface of said cushions and perpendicular to said guides, said bar being movable between first and second positions; and (ii) attachment means in the form of apertures in said bar adapted for engagement with complimentary means on said seat and back cushions in said first position and for disengagement with said complimentary in said second position; and (d) a releasable lock for securing said bar in said first position.

16. The seating unit according to claim 15, wherein said releasable lock is located between one end of said bar and said frame.

17. The seating unit according to claim 15, wherein at least one of said guides is attached to the inner surface of a vertically disposed end of said frame.

18. The seating unit according to claim 17 wherein said guides include generally front-to-back extending lower portions which are tilted so that the rear ends of said lower portions are lower than the front ends of said lower portion.

19. The seating unit according to claim 12, wherein said pair of oppositely disposed grooves extends partially along the length of said cushions and arranged so as to be visible only at the sides of said cushions.

20. The seating unit according to claim 15, wherein said cushions have a padded framework surrounded by an outer covering and said grooves are arranged on opposite sides of said framework.

21. The seating unit according to claim 15, wherein said back cushions are in overlying relationship with the innermost end of said bottom cushions so that said locking means is obscured by said back cushion.

22. The seating unit according to claim 15, wherein said complementary means is symmetrically shaped, thereby permitting said cushions to be reversed without adjusting the position of said locking bar.

23. The seating unit according to claim 22, wherein said complementary means is located along the rearward end of said seat cushions approximately equidistant from the sides and top and bottom surfaces thereof.

* * * * *